US007387594B1

(12) United States Patent
White et al.

(10) Patent No.: US 7,387,594 B1
(45) Date of Patent: Jun. 17, 2008

(54) EXERCISE APPARATUS WITH RESISTANCE MECHANISM

(75) Inventors: Eric C. White, Streamwood, IL (US); Thomas J. Danowski, Schaumburg, IL (US); John J. Hsing, Chicago, IL (US)

(73) Assignee: Brunswick Corporation, Lake Forest, IL (US)

( * ) Notice: Subject to any disclaimer, the term of this patent is extended or adjusted under 35 U.S.C. 154(b) by 621 days.

(21) Appl. No.: 10/972,566

(22) Filed: Oct. 25, 2004

(51) Int. Cl.
*A63B 21/00* (2006.01)

(52) U.S. Cl. ..... 482/52; 482/53; 482/112; 482/51

(58) Field of Classification Search ..... 482/53, 482/112, 51, 79, 80
See application file for complete search history.

(56) References Cited

U.S. PATENT DOCUMENTS

| | | | | |
|---|---|---|---|---|
| 5,183,449 | A * | 2/1993 | DeCloux | 482/53 |
| 5,236,407 | A * | 8/1993 | Wang | 482/113 |
| 5,256,118 | A * | 10/1993 | Chen | 482/53 |
| 5,370,592 | A * | 12/1994 | Wu | 482/53 |
| 2003/0017916 | A1 * | 1/2003 | Juan | 482/51 |

* cited by examiner

*Primary Examiner*—Jerome Donnelly
(74) *Attorney, Agent, or Firm*—Andrus, Sceales, Starke & Sawall, LLP

(57) ABSTRACT

Exercise apparatus has a pair of members exercising a pair of limbs of a user to alternate between and first and second opposite direction motions, such as a stepper or stair climber, and is provided with a resistance mechanism coupled to the pair of members and having first and second modes resisting motion, with the first mode resisting a first member moving in a first direction, and the second mode resisting the second member moving in the first direction.

4 Claims, 4 Drawing Sheets

EXERCISE APPARATUS WITH RESISTANCE MECHANISM

BACKGROUND AND SUMMARY

The invention relates to exercise apparatus including a resistance mechanism for exercising a pair of limbs of a user to alternate between first and second opposite direction motions, including steppers, stair climbers, and the like.

Exercise apparatus having a pair of members for exercising a pair of limbs of a user to alternate between first and second opposite direction motions are known in the prior art, including steppers, stair climbers, and the like. The pair of limbs, such as the user's legs, move oppositely to each other such that when one leg is moving in a first direction the other leg is moving in a second opposite direction, and vice versa.

The present invention provides in combination exercise apparatus of the above type having a simple and effective resistance mechanism.

DETAILED DESCRIPTION

Figure 1:
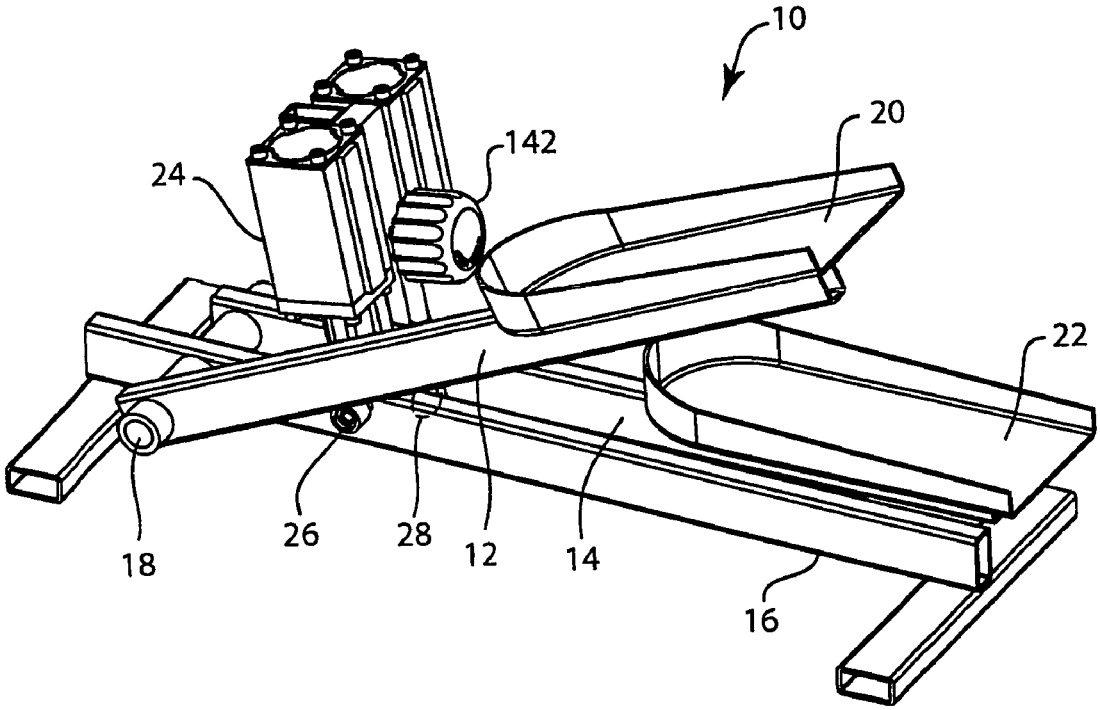
FIG. 1 is a perspective view of exercise apparatus including a resistance mechanism in accordance with the invention.

FIG. 1 shows exercise apparatus 10 having a pair of members 12, 14 for exercising a pair of limbs of a user to alternate between first and second opposite direction motions, for example a stepper or stair climber having a base 16 with cantilever members 12, 14 pivoted thereto at axle 18 and having respective footpads 20, 22 for alternate up-down movement of the user's feet and legs. The user's legs move oppositely to each other, such that when the left leg and left footpad 20 are moving downwardly, the right leg and right footpad 22 are moving upwardly; and when the left leg and left footpad 20 are moving upwardly, the right leg and right footpad 22 are moving downwardly. A resistance mechanism 24, to be further described, is coupled to the noted pair of members, e.g. at trunnion 26 on cantilever member 12, and as shown in dashed line at trunnion 28 on cantilever member 14. The resistance mechanism has first and second modes resisting motion. The first mode resists a first of the members moving in a first direction, e.g. member 12 and footpad 20 moving downwardly. The second mode resists the second member moving in the noted first direction, e.g. member 14 and footpad 22 moving downwardly. In a desirable aspect, the resistance to motion of both limbs of the user, i.e. both the downward movement of footpad 20 and the downward movement of footpad 22, is provided by a single common resistance mechanism. This alleviates problems in attempting to link or coordinate two resistance mechanisms or dampers consistently. A single resistance mechanism or damper also reduces cost as compared with two dampers. In a further desirable aspect, the resistance mechanism is switched between the noted first and second modes by the user reversing the direction of motion of his/her limbs. For example, the user merely shifts his/her weight from one foot to the other to change the noted resistance mode of the resistance mechanism between the noted first and second modes. In a further desirable aspect, a single bidirectional adjustment mechanism, to be described, is provided for varying resistance to both of the first and second members 12 and 14, providing uniform consistent resistance for each mode in each direction, without having to separately adjust and coordinate different dampers.

Figure 2:
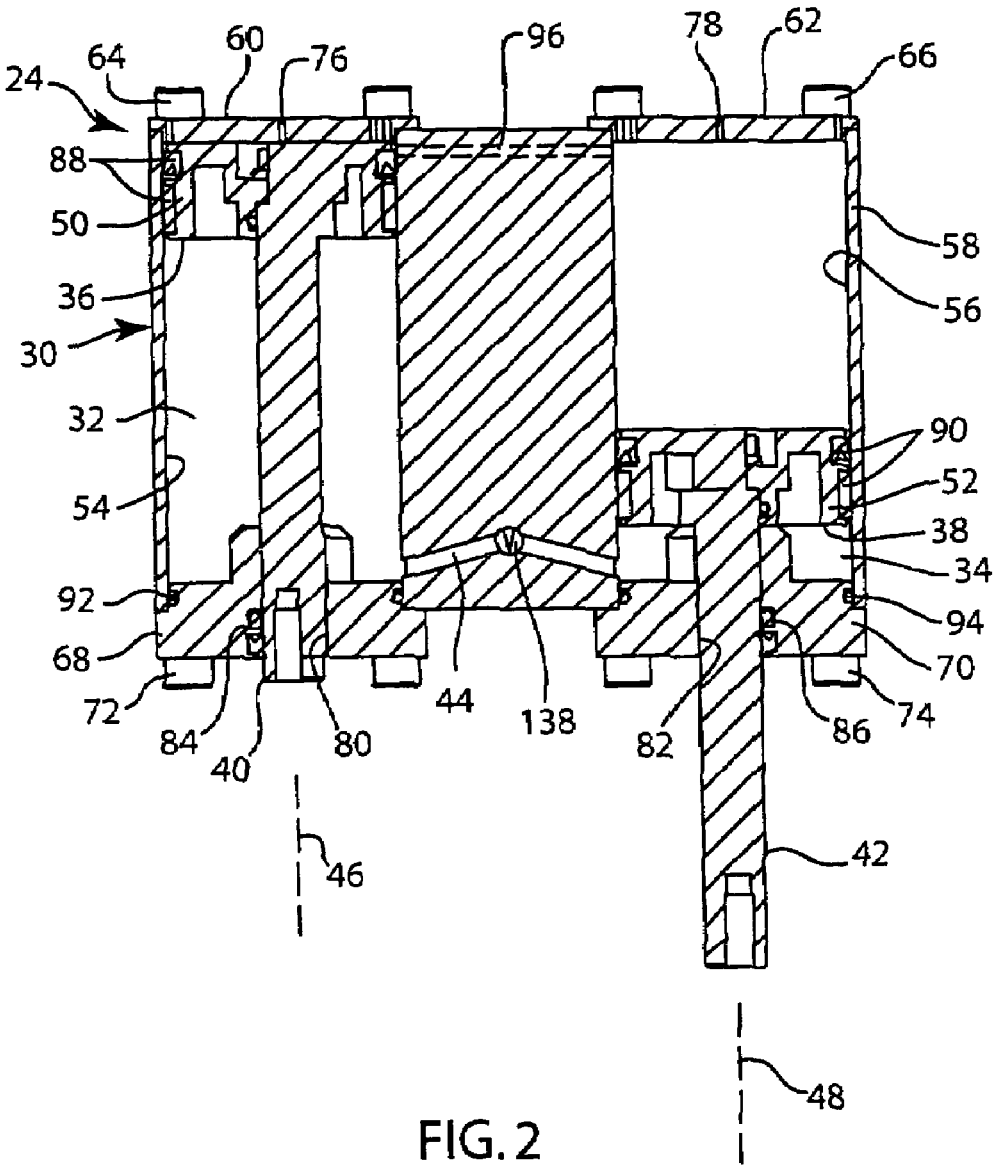
FIG. 2 is a sectional view of the resistance mechanism of FIG. 1.

In the preferred embodiment, resistance mechanism 24 is provided by a hydraulic damper 30, FIG. 2, having first and second hydraulic fluid chambers 32 and 34, first and second piston faces 36 and 38 each facing a respective chamber 32 and 34, and first and second links or piston rods 40 and 42 each connected between a respective piston face 36 and 38 and a respective exercise member 12 and 14, FIG. 1, e.g. at a respective trunnion 26 and 28. A transfer passage 44 is provided between chambers 32 and 34 and communicates hydraulic fluid therebetween. Movement of member 12 and footpad 20, FIG. 1, in the downward direction pulls piston link 40 and piston face 36 downwardly to shrink chamber 32 and transfer hydraulic fluid from chamber 32 through transfer passage 44 to chamber 34. Such movement of piston face 36 to shrink chamber 32 is resisted by the hydraulic fluid transfer through transfer passage 44. Movement of member 14 and footpad 22 in the downward direction, FIG. 1, pulls piston link 42 and piston face 38 downwardly to shrink chamber 34 and transfer hydraulic fluid from chamber 34 through transfer passage 44 to chamber 32. Downward movement of piston face 38 to shrink chamber 34 is resisted by hydraulic fluid transfer through transfer passage 44. When one of the piston faces is moving down, the other piston face is moving up, due to the transfer of hydraulic fluid through passage 44 and the shrinking of one of the chambers and the expanding of the other chamber.

In the embodiment of FIG. 2, the noted first and second piston faces 36 and 38 move along first and second parallel axes of movement 46 and 48, respectively, laterally spaced from each other, i.e. left and right in FIG. 1. First and second links 40 and 42 extend parallel to each other and in the same direction along the respective axis of movement 46 and 48 from a respective piston face 36 and 38. Piston faces 36 and 38 are on respective first and second pistons 50 and 52 movable along the respective axes 46 and 48 and laterally spaced from each other in respective first and second laterally spaced bores 54 and 56. First chamber 32 is in first bore 54. Second chamber 34 is in second bore 56. Transfer passage 44 extends between first and second bores 54 and 56 at first and second chambers 32 and 34, respectively.

Bores 54 and 56 are provided in damper housing 58 having upper end caps or plates 60 and 62 mounted thereto, e.g. by respective bolts such as 64, 66, and closing respective bores 54 and 56. The housing has lower end caps 68 and 70 mounted thereto by respective bolts such as 72 and 74 and closing respective bores 54 and 56. Upper end caps 60 and 62 have respective vent apertures 76 and 78 venting the respective portions of the bores above the respective pistons to permit upward and downward movement of such piston. Lower end caps 68 and 70 have respective central apertures or bores 80 and 82 receiving respective piston links or rods 40 and 42 movable therethrough along respective axes 46 and 48 upon movement of the respective piston 50 and 52. Link rods 40 and 42 are sealed within respective bores 80 and 82 in respective end caps 68 and 70 by respective seals 84 and 86. Pistons 50 and 52 are sealed within respective bores 54 and 56 for sliding movement therealong by respective piston rings or seals 88 and 90. End caps 68 and 70 may be sealed to the housing by respective seals such as 92 and 94. End caps 60 and 62 may be sealed to the housing if desired by respective seals (not shown). In an alternate embodiment, hydraulic fluid can also be transferred between bores 54 and 56 above pistons 50 and 52 by providing a second transfer passage such as shown in dashed line at 96 therebetween, and vents 76, 78 may be eliminated.

Figure 3:
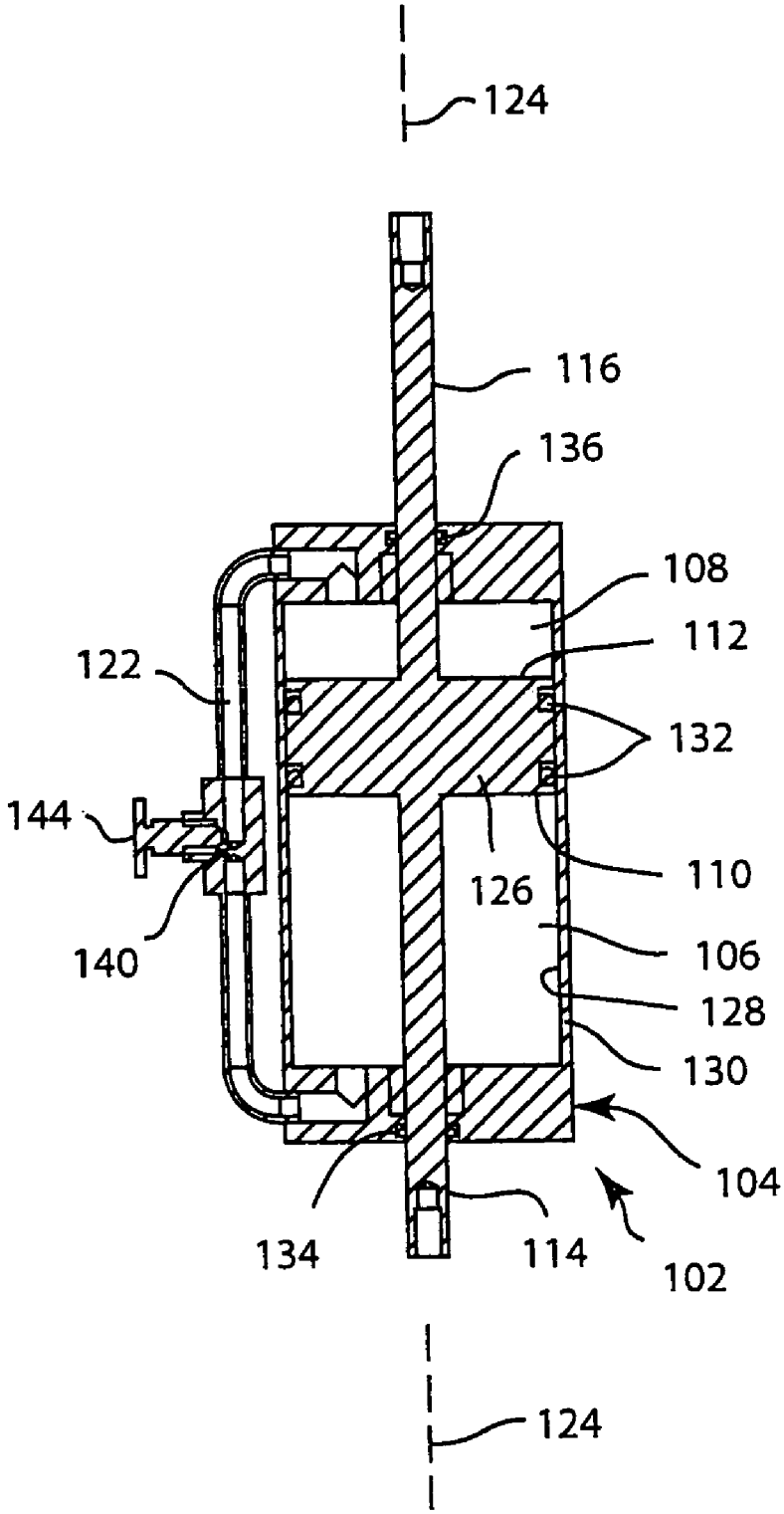
FIG. 3 is like FIG. 2 and shows another embodiment.
Figure 4:
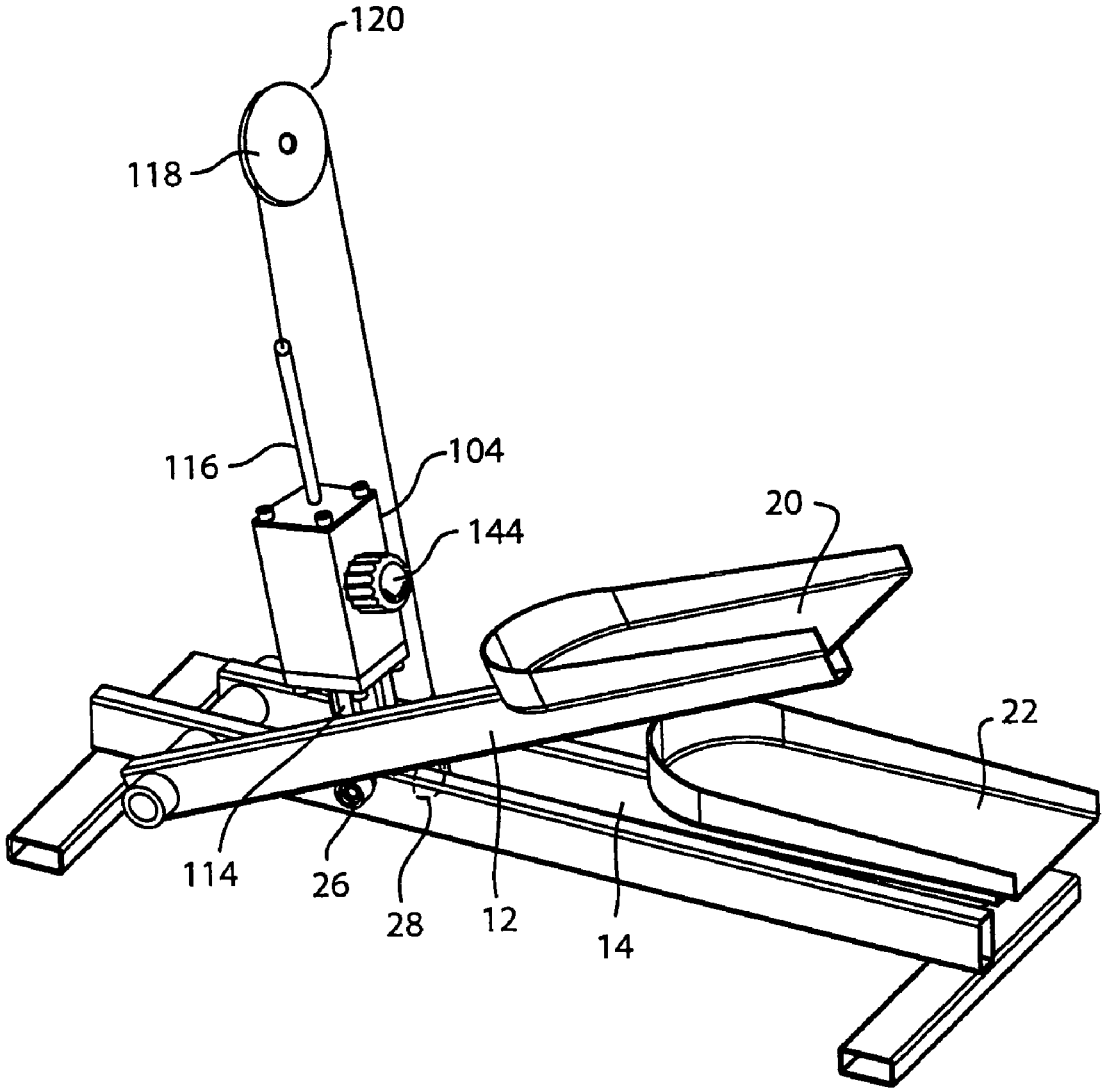
FIG. 4 is a perspective view of exercise apparatus incorporating the resistance mechanism of FIG. 3.

An alternate embodiment resistance mechanism 102 is shown at hydraulic damper 104 in FIG. 3. Hydraulic damper 104 has first and second hydraulic fluid chambers 106 and 108, first and second piston faces 110 and 112 each facing a respective chamber 106, 108, and first and second links or piston rods 114 and 116 each connected between a respective piston face 110, 112 and a respective exercise member 12, 14, e.g. by connection of link 114 to exercise member 12 at trunnion 26, and connection of link 116 through cable 118, FIG. 4, and pulley 120 to exercise member 14 at trunnion 28. Transfer passage 122, FIG. 3, is provided between chambers 106 and 108 and communicates hydraulic fluid therebetween, such that movement of exercise member 12 and footpad 20 downwardly moves link 114 and piston face 110 downwardly to shrink chamber 106 and transfer hydraulic fluid from chamber 106 through transfer passage 122 to chamber 108. Downward movement of piston face 110 to shrink chamber 106 is resisted by hydraulic fluid transfer through transfer passage 122. Movement of exercise member 14 and footpad 22 in the downward direction moves piston face 112 upwardly (via cable and pulley system system 118, 120) to shrink chamber 108 and transfer hydraulic fluid from chamber 108 through transfer passage 122 to chamber 106. Upward movement of piston face 112 to shrink chamber 108 is resisted by hydraulic fluid transfer through transfer passage 122.

In the embodiment of FIG. 3, first and second piston faces 110 and 112 move along a common coaxial axis of movement 124. First and second piston rod links 114 and 116 extend distally oppositely from first and second piston faces 110 and 112, respectively, along the noted common coaxial axis of movement 124. First link 114 extends in a first direction, e.g. downwardly, from first piston face 110. Second link 116 extends in a second direction, e.g. upwardly, from second piston face 112. The noted second direction of extension of second link 116 from second piston face 112 is opposite to the noted first direction of extension of first link 114 from first piston face 110. The noted first and second directions of extension of links 114, 116 lie along common coaxial axis of movement 124. First and second piston faces 110 and 112 are on distally opposite sides of a common central piston 126 movable back and forth along axis 124, such that shrinking of first chamber 106 enlarges second chamber 108, and shrinking of second chamber 108 enlarges first chamber 106. Piston 126 may be sealed within bore 128 of housing 130 by seal rings such as 132. Links 114, 116 may be sealed by respective seal rings 134, 136.

In each of the embodiments of FIGS. 2 and 3, a respective bidirectional metering valve 138, 140 is provided in the respective transfer passage 44, 122 for varying resistance to the flow of hydraulic fluid therethrough to vary resistance to movement of both of the first and second exercise members 12 and 14. The valve is preferably provided by a variable orifice for varying the cross-sectional area of flow restriction. Each of the valves has a user engagable knob 142, 144, respectively, for adjusting the respective valve to vary the noted resistance.

The resistance mechanism 24, 102 is switched between the noted first and second modes by the user reversing the direction of motion of his/her limbs, e.g. by shifting weight from the right foot at footpad 22 to the left foot at footpad 20, and vice versa. The resistance to motion at respective footpads 20, 22 is provided by a single common resistance mechanism. The respective valve 138 or 140 provides a bidirectional adjustment mechanism for varying resistance to both of the exercise members 12 and 14, which resistance to movement of both members 12 and 14 is provided by the same adjustment mechanism. The use of the same single common adjustment mechanism is desirable, as well as the use of the same single common resistance mechanism.

It is recognized that various equivalents, alternatives and modifications are possible within the scope of the appended claims. The invention is particularly useful with steppers, stair climbers, and the like, though it may be used in conjunction with various other types of exercise apparatus for exercising a pair of limbs of a user.

What is claimed is:

1. Exercise apparatus having a pair of members for exercising a pair of limbs of a user to alternate between first and second opposite direction motions and to move oppositely to each other such that when one limb is moving in said first direction the other limb is moving in said second direction, and when said one limb is moving in said second direction said other limb is moving in said first direction, a resistance mechanism coupled to said pair of members and having first and second modes resisting motion, said first mode resisting a first of said members moving in said first direction, said second mode resisting a second of said members moving in said first direction, wherein said resistance mechanism comprises a hydraulic damper having first and second hydraulic fluid chambers, first and second piston faces each facing a respective said chamber, and first and second links each connected between a respective said piston face and a respective said member, and comprising a transfer passage between said first and second chambers and communicating hydraulic fluid therebetween, such that movement of said first member in said first direction moves said first link and said first piston face to shrink said first chamber and transfer hydraulic fluid from said first chamber through said transfer passage to said second chamber, wherein said movement of said first piston face to shrink said first chamber is resisted by said hydraulic fluid transfer through said transfer passage, and such that movement of said second member in said first direction moves said second link and said second piston face to shrink said second chamber and transfer hydraulic fluid from said second chamber through said transfer passage to said first chamber, wherein said movement of said second piston face to shrink said second chamber is resisted by said hydraulic fluid transfer through said transfer passage, wherein said first and second piston faces move along a common coaxial axis of movement.

2. The exercise apparatus according to claim 1 wherein said first and second links extend distally oppositely from said first and second piston faces along said common coaxial axis of movement, said first link extending in a first direction from said first piston face, said second link extending in a second direction from said second piston face, said second direction of extension of said second link from said second piston face being opposite to said first direction of extension of said first link from said first piston face, said first and second directions of extension of said links lying along said common coaxial axis of movement.

3. The exercise apparatus according to claim 1 wherein said first and second piston faces are on distally opposite sides of a common central piston movable back and forth along said common coaxial axis of movement, and wherein shrinking of said first chamber enlarges said second chamber, and shrinking of said second chamber enlarges said first chamber.

4. The exercise apparatus according to claim 1 comprising a transfer passage between said first and second chambers and communicating hydraulic fluid therebetween, such that movement of said first member in said first direction moves said first link and said first piston face to shrink said first chamber and transfer hydraulic fluid from said first chamber through said transfer passage to said second chamber, wherein said movement of said first piston face to shrink said first chamber is resisted by said hydraulic fluid transfer through said transfer passage, and such that movement of said second member in said first direction moves said second link and said second piston face to shrink said second chamber and transfer hydraulic fluid from said second chamber through said transfer passage to said first chamber, wherein said movement of said second piston face to shrink said second chamber is resisted by said hydraulic fluid transfer through said transfer passage, and comprising a bidirectional metering valve in said transfer passage for varying resistance to movement of both of said first and second members.

* * * * *